United States Patent [19]

Conn

[11] Patent Number: 4,574,585

[45] Date of Patent: Mar. 11, 1986

[54] COMPRESSOR BLEED VALVE

[75] Inventor: Francis E. Conn, Plainfield, Ind.

[73] Assignee: General Motors Corporation, Detroit, Mich.

[21] Appl. No.: 699,596

[22] Filed: Feb. 8, 1985

[51] Int. Cl.[4] ..... F02C 9/18

[52] U.S. Cl. ..... 60/39.29; 415/27

[58] Field of Search ..... 60/39.27, 39.29; 415/26, 27, 28

[56] References Cited

U.S. PATENT DOCUMENTS

| | | | |
|---|---|---|---|
| 2,969,805 | 1/1961 | Hunter | 415/27 |
| 3,804,112 | 4/1974 | Harner | 137/489 |
| 3,809,490 | 5/1974 | Harner | 60/39.29 |
| 3,924,960 | 12/1975 | Harner et al. | 415/28 |
| 4,251,985 | 2/1981 | Sullivan | 60/39.29 |

*Primary Examiner*—Louis J. Casaregola

*Attorney, Agent, or Firm*—Saul Schwartz

[57] ABSTRACT

A bleed valve for a compressor wherein compressor discharge pressure is proportional to compressor rotor speed, the bleed valve including a bleed control poppet valve, a pair of differential pressure diaphragms, a pressure regulator valve, and an accumulator. The bleed valve automatically effects bleed air flow in proportion to the rate of acceleration of the compressor rotor when the rate of compressor rotor acceleration exceeds a scheduled maximum rate and for a predetermined duration after the onset of compressor rotor deceleration at a rate above a minimum scheduled rate.

6 Claims, 3 Drawing Figures

COMPRESSOR BLEED VALVE

BACKGROUND OF THE INVENTION

1. Field of the Invention

This invention relates generally to compressors wherein compressor discharge pressure is proportional to compressor rotor speed and, more particularly, to bleed valves for avoiding surge in such compressors.

2. Description of Prior Art

Because engine performance limiting compressor surge in gas turbine engines is advantageously avoided by selectively bleeding compressed air, many automatic bleed valves have been proposed. In one pertinent valve compressor bleed as a function of compressor pressure ratio is effected by a bleed control poppet, the position of which is determined by a diaphragm exposed on one side to a control pressure proportional to compressor discharge pressure and on the other side to atmospheric pressure. In another pertinent valve where compressor bleed is primarily a function of compressor pressure ratio, a secondary control element is operative to initiate compressor bleed as a function of the rate of increase of compressor discharge pressure in the event that compressor output is blocked. A bleed valve according to this invention schedules compressor bleed as a function of compressor rotor acceleration during periods of rotor acceleration and also initiates compressor bleed for a predetermined period after the onset of rotor deceleration to condition the compressor for surge-free operation in the event of rapid reacceleration of the compressor rotor.

SUMMARY OF THE INVENTION

Accordingly, the primary feature of this invention is that it provides a new and improved bleed valve for a gas turbine engine compressor. Another feature of this invention resides in the provisions in the new and improved bleed valve of bleed scheduling means operative to initiate compressor bleed at the onset of acceleration of a rotor of the compressor above a maximum scheduled acceleration rate and to modulate compressor bleed in proportion to the rate of rotor acceleration and also operative to initiate compressor bleed at the onset of rotor deceleration at a rate above a predetermined minimum scheduled deceleration rate and to maintain compressor bleed for a predetermined duration. Still another feature of the invention resides in the provision in the new and improved bleed valve of a bleed control poppet valve, the position of which is determined by the position of a diaphragm exposed to compressor discharge pressure and to a servo pressure regulated in inverse proportion to the rate of acceleration of the compressor rotor so that at rates of acceleration above a maximum scheduled rate, the differential between compressor discharge pressure and servo pressure is sufficient to move the poppet to an open position bleeding compressed air. Yet another feature of this invention resides in the provision in the new and improved bleed valve of servo pressure regulating means including an exhaust valve for regulating servo pressure and a second diaphragm connected to the exhaust valve exposed on one side to a control pressure proportional to compressor discharge pressure and on the other side to the same pressure conveyed to the second diaphragm through an orifice so that the position of the second diaphragm and the operational state of the exhaust valve are functions of the rate of increase of the control pressure and, hence, the rate of acceleration of the compressor rotor. And still another feature of this invention resides in the provision in the new and improved bleed valve of an accumulator connected to the orifice side of the second diaphragm whereby the net pressure differential across the second diaphragm is reversed and maintained for a predetermined duration after the onset of rotor deceleration at rates above a scheduled minimum rate so that the second diaphragm moves in the opposite direction and opens the exhaust valve to initiate compressor bleed during rotor deceleration whereby the compressor is conditioned for surge-free operation in the event of rapid reacceleration of the engine.

These and other features of the invention will be readily apparent from the following specification and from the drawings wherein.

Figure 1:
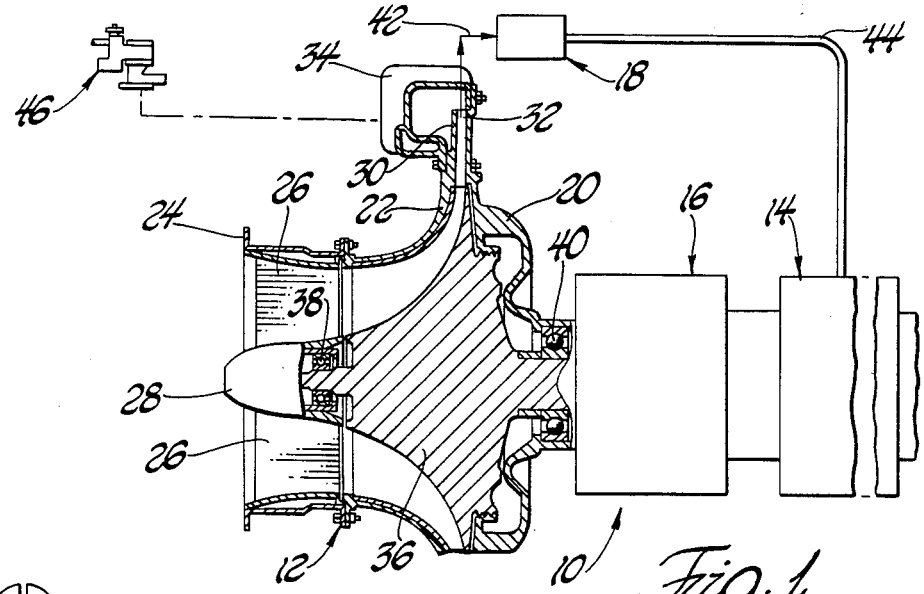
FIG. 1 is a partially schematic view of a gas turbine engine having a compressor bleed valve according to this invention.

Referring now to FIG. 1 of the drawings, a gas turbine engine 10 includes a compressor section 12, a power turbine section 14, a power and accessory gear box 16 interconnecting the power turbine and compressor sections, and a combustor 18. The compressor section 12 is a modular unit cantilever mounted on the front of the gear box 16 and includes a rear stationary housing 20 and front stationary housing 22. The front stationary housing 22 has a cylindrical inlet end 24 in which are rigidly mounted a plurality of radial struts 26 whereby a hub 28 is rigidly supported in the center of the inlet end 24. The front housing 22 has an outlet end 30 which cooperates with the rear housing 20 in defining an annular outlet 32 in communication with a stationary scroll chamber 34. A single stage centrifugal compressor rotor 36 is straddle mounted between the front and rear housings 22 and 20 on a front bearing assembly 38 in the hub 28 and a rear bearing assembly 40 on the rear housing 20. The rotor 36 is drive connected to the turbine section 14 through the power and accessory gear box 16 whereby the rotor is rotated at high speed to compressively force ambient air from the inlet end 24 into the scroll chamber 34 thereby to maintain the air in the scroll chamber at a compressor discharge pressure ($P_C$) proportional to the speed of the rotor 36.

Compressed air at $P_C$ is conveyed from the scroll chamber 34 to the combustor 18 through a duct 42. The compressed air is mixed with fuel in the combustor and the mixture ignited to generate a continuous stream of high energy, hot gas motive fluid which is conducted to the power turbine section 14 through a transition conduit 44. Within the turbine section 14, the motive fluid is expanded through a nozzle and through the blades of one or more turbine wheels rotatably supported in the turbine section and coupled to the rotor 36 through the power and accessory gear box, the latter being operative to also provide a shaft power output for driving an accessory device such as a helicopter rotor.

The compressor has a performance map, not shown, defining a performance envelope within which the compressor will operate surge-free. A compressor bleed valve 46 according to this invention is disposed on the scroll chamber 34 and functions as described hereinafter to maximize the performance envelope by automatically bleeding compressed air from the scroll chamber in accordance with a schedule embodied in the bleed valve.

Figure 2:
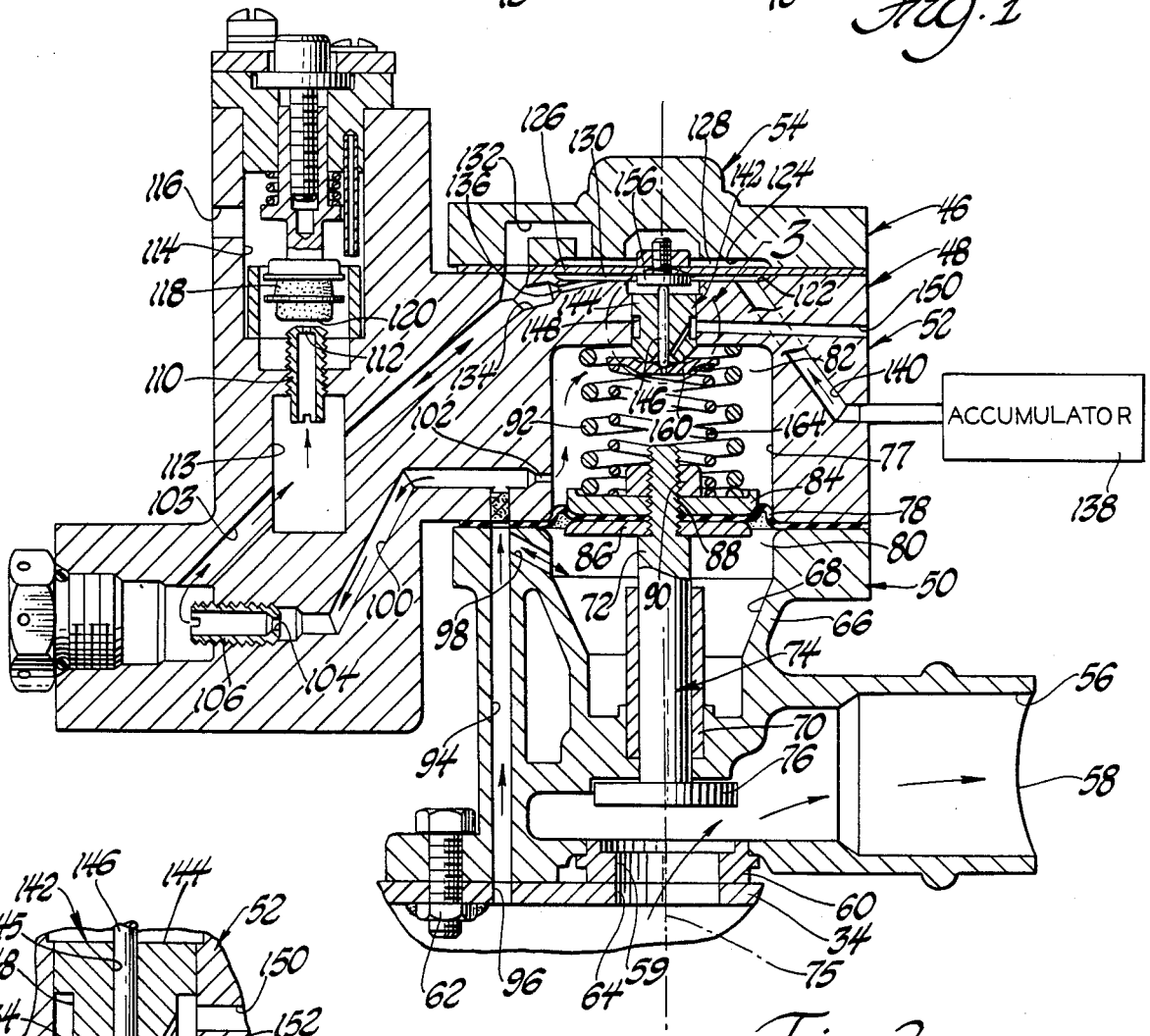
FIG. 2 is an enlarged view of a portion of FIG. 1 showing the compressor bleed valve according to this invention.

Referring now to FIG. 2 of the drawings, the bleed valve 46 includes a valve body assembly 48 having a lower body 50, a middle body 52 and an upper body 54 all fastened together to provide a rigid assembly. The lower body 50 includes a bleed passage 56 having an outlet 58 exposed to the atmosphere and an inlet opening 59 around which is disposed a valve seat 60. The lower body 50 is rigidly attached to the scroll chamber 34, as by a bolt 62, with an orifice 64 in the scroll chamber registering with the opening 59 and the valve seat 60 so that an unobstructed flow path is defined from the interior of the scroll chamber 34 to the atmosphere.

A center web 66 of the lower body 50 defines an upwardly facing cavity 68 and supports a sleeve 70 in which is disposed a stem 72 of a poppet valve 74 whereby the valve is slidable along an axis 75 of the valve body assembly 48. The poppet valve has a head 76 and is vertically slidable on the axis 75 between a closed position, not shown, wherein the head 76 seats against the valve seat 60 to terminate connection between the scroll chamber 34 and the bleed passage 56, and a plurality of open positions wherein the head 76 is disposed progressively further above the valve seat 60, a full open position of the poppet valve being shown in FIG. 2.

The middle body 52 has a cavity 77 aligned with the cavity 68 in the lower body 50. A first diaphragm 78 of the rolling lobe type sealingly captured between the lower body 50 and the middle body 52 cooperates with the cavity 68 in defining a compressor discharge chamber 80 below the diaphragm and with the cavity 77 in defining a servo chamber 82 above the diaphragm. A pair of plates 84 and 86 on opposite sides of the diaphragm 78 are received over a threaded end 88 of the valve stem 72 and are retained on the latter by a nut 90. Accordingly, movement of the diaphragm 78 along the axis 75 effects concurrent movement of the poppet valve 74 between the closed position and any of a plurality of open positions up to the full open position. A spring 92 in the servo chamber 82 seats at one end against the middle body 52 and at the other end against the plate 84 whereby the poppet valve 74 is resiliently biased to the closed position.

A first passage 94 in the lower body 50 registers with an opening 96 in the scroll chamber 34 and is intersected by a second passage 98 in the lower body whereby compressed air at $P_C$ is continuously supplied to the compressor discharge chamber 80. The first passage 94 continues into the middle body 52 wherein it intersects a third passage 100. The third passage 100 communicates with the servo chamber 82 through an orifice 102 and with a fourth passage 103 in the middle body through an orifice 104 in a first removable element 106. A second removable element 110 on the middle body 52 has an orifice 112 therein providing communication between an enlarged portion 113 of the fourth passage 103 and a chamber 114 in the middle body exposed to the atmosphere through a vent 116. An evacuated bellows 118 is suspended in the chamber 114 above the orifice 112 and includes an end face 120 which moves closer to the orifice 112 as atmospheric pressure decreases so that air flow through the orifice 112 is progressively restricted as atmospheric pressure decreases.

A shallow circular cavity 122 in the upper surface of middle body 52 is aligned generally on the longitudinal axis 75 and registers with a correspondingly shaped cavity 124 in the lower surface of upper body 54. A metal second diaphragm 126 captured between the upper and middle bodies cooperates with the upper body in defining a primary control chamber 128 above the diaphragm and with the middle body in defining a secondary control chamber 130 below the diaphragm. The primary control chamber 128 communicates with the fourth passage 103 through a branch passage 132 in the upper and middle bodies. Similarly, the secondary control chamber 130 communicates with the fourth passage 103 through a second branch passage 134 having a flow control orifice 136 therein. The secondary control chamber also communicates with a pressure accumulator 138 through a passage 140 in the middle body 52.

Figure 3:
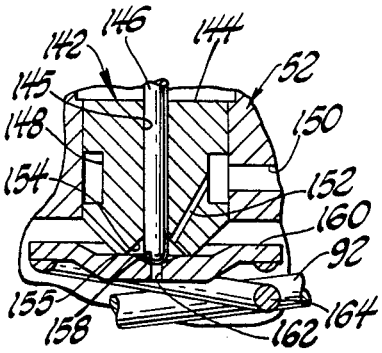
FIG. 3 is an enlarged view of a portion of FIG. 2, designated by arrowed circle 3, showing the exhaust valve of the compressor bleed valve according to this invention.

Referring now to FIGS. 2 and 3, a servo pressure ($P_X$) is established in servo chamber 82 by an exhaust valve 142 which includes a guide 144 rigidly mounted on the middle body 52. The guide 144 has a bore 145 in which a push pin 146 is supported for vertical sliding movement along the axis 75. An annular groove 148 in the guide 144 registers with a vent passage 150 in the middle body 52 which opens to the atmosphere. A cross bore 152 in the guide 144 extends between the annular groove 148 and a counter sunk end 154 of the bore 145, the counter sunk end 154 opening into servo chamber 82 through a lower surface 155 of the guide 144.

The upper end of the pin 146 bears against a button 156 on the metal diaphragm 126. The lower end of the pin 146 seats in a depression 158 in a generally disc-like stopper 160 adapted to abut the lower surface 155 of the guide 144 over the counter sunk end 154. The stopper 160 has an orifice 162 therethrough aligned with the depression 158 so that the lower end of the pin 146, when seated against the stopper, sealingly closes the orifice 162. In addition, the stopper 160 defines a spring seat against which bears one end of a feedback spring 164 in the servo chamber 82, the other end of the feedback spring bearing against plate 84.

When the engine is off, all of the chambers and passages in the bleed valve 46 are pressure equalized at atmospheric pressure. Spring 92 biases the head 76 of the poppet valve 74 against the seat 60, metal diaphragm 126 is self-biased to a planar neutral position, shown in FIG. 2, and the feedback spring 164 biases the stopper 160 against guide 144 with orifice 162 sealed by the end of pin 146. During transition from engine off to self-sustaining stability at ground idle, the rotor 36 accelerates from rest to an idle speed with a corresponding increase of $P_C$ from zero to an idle level pressure. During the engine starting sequence, $P_C$ is distributed by passage 94 to third passage 100 and, by second passage 98, to compressor discharge chamber 80 where it acts on the lower surface of the diaphragm 78. With a time delay due to orifice 102, $P_C$ enters servo chamber 82 where it is contained because stopper 160 and pin 146 prevent communication with cross bore 152. Simultaneously, $P_C$ is reduced by orifices 104 and 112 to a lower control pressure ($P_R$) the magnitude of which is directly proportional to $P_C$ and which likewise increases from zero to an idle level. $P_R$ is distributed to primary control chamber 128 above the metal diaphragm and, with a time delay due to orifice 136, to the secondary control chamber 130 below the diaphragm and from the latter to the accumulator 138 through the passage 140. The pressure differential across the metal diaphragm 126, created by the time delay of air passage through the orifice 136, is proportional to the rate of increase of $P_R$ and, hence, is also proportional to the rate of increase of $P_C$ and to the rate of acceleration of the compressor rotor 36. During the engine starting sequence, however, the magnitude of the pressure differential across the metal diaphragm is not sufficient to unseat the stopper 160 against the force of feedback spring 164 in the servo chamber so that poppet valve 74 remains closed during the entire starting sequence.

When the engine stabilizes at idle speed, $P_C$ in compressor discharge chamber 80 and $P_X$ in servo chamber 82 equalize at idle level compressor discharge pressure because servo chamber 82 is closed. Likewise, $P_R$ in primary and secondary control chambers 128 and 130 stabilizes at an idle level control pressure and the accumulator 138 is charged to a degree corresponding to idle level control pressure magnitude. Engine transition from idle to a flight power level is accompanied by acceleration of the rotor 36 at a rate proportional to a command input from the pilot with corresponding rates of increase of $P_C$ and $P_R$. $P_C$ in compressor discharge chamber 80 increases substantially simultaneously with rotor speed increase while $P_X$ in servo chamber 82 and $P_R$ in passages 132 and 134 increase at the same rate but with a slight time delay due to orifices 102 and 104, respectively. The time delay created by orifice 102 is not sufficient to establish, by itself, a pressure difference across diaphragm 78 large enough to move poppet valve 74 from the closed position against spring 92. Accordingly, without modulation of $P_X$ in servo chamber 82, the poppet valve remains closed.

$P_R$ in passages 132 and 134 increases at the rate of increase of $P_C$ and is conveyed directly into the primary control chamber 128. Orifice 136 impedes the flow of $P_R$ into secondary control chamber 130 so that a pressure difference proportional to the rate of increase of $P_R$ develops across the metal diaphragm 126 urging the diaphragm downward against the latters own self bias and that of feedback spring 164 as transferred through the stopper 160 and pin 146. The self bias of diaphragm 126 and the rate of feedback spring 164 are scheduling parameters which determine or schedule the maximum rate of increase of $P_R$, and hence the maximum rate of acceleration of the compressor rotor, below which no modulation of $P_X$ occurs and poppet valve 74 remains closed. In practice, diaphragm 126 and feedback spring 164 cooperate to schedule poppet valve 74 in the closed position at all rates of compressor rotor acceleration below a predetermined maximum rate defining the upper limit of surge-free operation of the compressor. When the rate of acceleration of the compressor rotor exceeds the predetermined maximum, the pressure difference across metal diaphragm 126 is sufficient to move the latter downward whereby button 156 forces the stopper 160 off of surface 155 of the guide 144 through pin 146. With the stopper thus unseated, air escapes from the servo chamber 82 through cross bore 152 and vent passage 150 and $P_X$ decreases to an acceleration servo pressure so that a pressure differential develops across diaphragm 78 urging the latter upward against spring 92. When the force of spring 92 is exceeded by the net pressure force on diaphragm 78, poppet valve 74 moves upward from the closed position toward the full open position, FIG. 2, permitting bleed air to escape from the scroll chamber through the passage 56.

The rate at which compressed air is bled from the scroll chamber 34 is proportional to the amount by which the actual rate of compressor rotor acceleration exceeds the aforementioned predetermined maximum rate. More particularly, the rate at which compressed air is bled from the scroll chamber 34 is a function of the size of the gap between valve head 76 and valve seat 60. As poppet valve 74 moves from the closed toward the full open position and the gap increases, the feedback spring 164 is further compressed and, at some point in the travel of the poppet valve depending upon the magnitude of the net downward pressure force on the metal diaphragm 126, overcomes that net downward pressure force and reseats the stopper 160. At that instant, servo chamber 82 is resealed and $P_X$ starts to increase so that the diaphragm 78 starts to move downward and feedback spring 164 starts to expand. As the feedback spring expands, of course, the force exerted thereby decreases and the stopper 160 unseats from surface 155 and $P_X$ begins to decrease to initiate a repeat of the cycle. Accordingly, $P_X$ in servo chamber 82 is regulated at an acceleration servo pressure level proportional to the net downward pressure force on metal diaphragm 126 and determines a corresponding position of poppet valve 74 relative to valve seat 60. If the net downward pressure force is large, i.e., the actual rate of compressor rotor acceleration substantially exceeds the predetermined maximum, then the poppet valve 74 will move to the full open position before regulation of $P_X$ commences and compressed air will be bled at a maximum rate. If the net downward pressure force is small, i.e., the actual rate of compressor rotor acceleration only somewhat exceeds the predetermined maximum, then regulation of $P_X$ will commence at an open position of the poppet valve below the full open position and the rate at which compressed air is bled from the scroll chamber will be correspondingly lower.

Since the rate of change of $P_C$ degrades with increased altitude, and surge avoidance becomes more essential, it is necessary for the bleed valve 46 to become increasingly sensitive to the rate of change of compressor discharge pressure as altitude increases. This is accomplished by scaling $P_R$ in passages 103, 132 and 134 as a greater percentage of $P_C$. The evacuated bellows 118 serves to decrease the effective size of the orifice 112 as altitude increases and atmospheric pressure in chamber 114 decreases. The reduction in effective size of the orifice 112 causes $P_R$ to increase to a higher percentage of $P_C$. With $P_R$ being a higher percentage of $P_C$, the bleed valve is more sensitive to the rate of change of $P_C$, and, hence, more sensitive to the rate of compressor rotor acceleration.

When the engine achieves stability at a flight power level, $P_C$ ceases increasing and stabilizes at an elevated level corresponding to the flight power requirement. Concurrently, $P_R$ in secondary control chamber 130 and in accumulator 138 equalizes with $P_R$ in primary control chamber 128. The feedback spring 164 then forces the stopper 160 back against surface 155 of guide 144 to reseal servo chamber 82 whereupon $P_X$ in the latter increases to a level equal to $P_C$. Accordingly, spring 92 forces the poppet valve 74 back to the closed position terminating the flow of bleed air from the scroll chamber. Accordingly, no air is bled from the scroll chamber during steady state flight operation of the engine.

The accumulator 138 cooperates with the metal diaphragm 126 and the pin 146 in effecting compressor bleed during engine deceleration so that the bleed valve 46 is conditioned for surge avoidance in the event that the pilot commands rapid engine reacceleration. More particularly, when the pilot signals deceleration and reduces fuel supply to the engine, the compressor rotor begins to decelerate causing a drop in $P_C$ and, concurrently, a proportional drop in $P_R$ in the passages 132 and 134. $P_R$ in primary control chamber 128 decreases essentially simultaneously with decreasing $P_R$ in passage 132. $P_R$ in control chamber 130 and in accumulator 138, however, decreases less rapidly due to the restriction created by orifice 136 so that a net upward pressure force develops on the metal diaphragm resisted only by the stiffness of the diaphragm. If the rate of compressor rotor deceleration exceeds a minimum rate scheduled by the stiffness of the metal diaphragm, the net upward pressure force will move the metal diaphragm upward from the neutral position thereof. As the metal diaphragm moves upward, $P_X$ in servo chamber 82, acting on the end of pin 146 through the orifice 162, unseats the end of the pin from the orifice so that servo chamber 82 is vented to the atmosphere through the orifice 162, the cross bore 152 and the passage 150. Consequently, the $P_X$ in servo chamber 82 quickly decreases to a deceleration servo pressure level sufficient to permit upward movement of the poppet valve 74 toward the full open position allowing compressed air to be bled from the scroll chamber 34. This condition obtains for a predetermined duration after the onset of rotor deceleration above the predetermined minimum rate which period is a function of the characteristics of accumulator 138 and the size of orifice 136. When the pressure in the accumulator is sufficiently discharged, the metal diaphragm returns to the neutral position and seats the pin 146 in the orifice 162 so that $P_X$ in the servo chamber 82 increases to the level of $P_C$ thereby allowing spring 92 to return poppet valve 74 to the closed position. If at any time during the period in which the accumulator 138 is discharging the pilot commands a reacceleration of the engine, the poppet valve 74 will already be in an open position conditioned for instantaneous bleeding of compressed air from the scroll chamber and avoidance of operation of the compressor in the region of surge instability.

The embodiments of the invention in which an exclusive property or privilege is claimed are defined as follows:

1. In combination with a compressor supplying compressed air at a compressor discharge pressure proportional to the speed of a rotor of said compressor, a bleed valve comprising, a valve body defining a bleed passage operative to bleed air compressed by said compressor to a lower pressure, a valve on said body movable between a closed position blocking said bleed passage and a plurality of open positions defining corresponding bleed flow rate through said bleed passage, spring means exerting a spring force on said valve biasing said valve to said closed position, means on said body defining a first chamber and a second chamber each supplied with air at said compressor discharge pressure, acceleration regulator valve means connected to said first chamber and to said compressor operative to regulate an acceleration servo pressure in said first chamber inversely proportional to the rate of acceleration of said rotor whenever said acceleration rate exceeds a predetermined maximum rate, actuating means connected to said valve and to said first and said second chambers operative to exert on said valve against said spring force a net pressure force exceeding said spring force and proportional to the difference between said acceleration servo pressure and said compressor discharge pressure whereby said valve is moved to one of said open positions defining a bleed flow rate proportional to the amount by which said rotor acceleration rate exceeds said predetermined maximum rate, and deceleration regulator valve means connected to said first chamber and to said compressor operative in response to deceleration of said rotor at rates above a predetermined minimum rate to exhaust said first chamber and establish therein for a predetermined duration after the onset of said rotor deceleration a deceleration servo pressure below said compressor discharge pressure, said actuating means exerting on said valve against said spring force a net pressure force exceeding said spring force proportional to the difference between said deceleration servo pressure and said compressor discharge pressure whereby said valve is moved to said open position for said predetermined duration.

2. The bleed valve recited in claim 1 wherein said actuating means includes means on said valve body defining a cavity, a first diaphragm on said valve body dividing said cavity into said first chamber and said second chamber, and means connecting said first diaphragm to said valve so that movement of said first diaphragm effects concurrent movement of said valve between said closed and said open positions.

3. The bleed valve recited in claim 2 wherein said acceleration regulator valve means includes means on said valve body defining a second cavity, a second diaphragm on said valve body dividing said second cavity into a primary control chamber and a secondary control chamber, means resiliently biasing said second diaphragm to a neutral position, passage means connected to said compressor and to each of said primary and said secondary control chambers having first orifice means therein operative to establish in said passage means a control pressure proportional to said compressor discharge pressure, second orifice means on said valve body restricting air flow between said passage means and said secondary control chamber so that during acceleration of said rotor a first net pressure force proportional to the rate of acceleration of said rotor is exerted on said second diaphragm urging the latter from said neutral position in a first direction, an exhaust valve on said body connected to said first chamber and biased to a closed position, and means connecting said second diaphragm to said exhaust valve operative when said first net pressure force exceeds said exhaust valve bias and said second diaphragm moves in said first direction to open said exhaust valve so that said exhaust valve regulates said acceleration servo pressure in said first chamber proportional to the rate of acceleration of said rotor.

4. The bleed valve recited in claim 3 wherein said second diaphragm is fabricated from metal and is self biased to said neutral position.

5. The bleed valve recited in claim 4 wherein said deceleration regulator valve means includes a pressure accumulator connected to said secondary control chamber and operative with said second orifice means during deceleration of said rotor to exert and maintain for a predetermined duration after the onset of said rotor deceleration a second net pressure force on said second diaphragm proportional to the rate of deceleration of said rotor urging said second diaphragm in a second direction from said neutral position, said second diaphragm moving in said second direction when said second net pressure force exceeds said self bias and said connecting means being operative to actuate said exhaust valve when said second diaphragm moves in said second direction whereby said deceleration servo pressure is established in said first chamber.

6. The bleed valve recited in claim 5 wherein said exhaust valve includes means on said valve body defining an exhaust passage between said first chamber and the atmosphere, a stopper in said first chamber movable between a seated position covering said exhaust passage and an unseated position exposing said exhaust passage, a feedback spring between said valve and said stopper biasing said stopper to said seated position, means defining an orifice in said stopper aligned with said exhaust passage permitting communication between said exhaust passage and said first chamber with said stopper in said seated position, and a push pin slidably disposed on said valve body between said second diaphragm and said stopper with an end of said push pin seated on said stopper over said orifice so that movement of said second diaphragm in said first direction is transferred to said stopper whereby the latter is moved to said unseated position against said feedback spring and movement of said second diaphragm in said second direction allows servo pressure induced movement of said push pin off of said stopper orifice exhausting said first chamber.

* * * * *